United States Patent [19]

Hug

[11] 4,082,308

[45] Apr. 4, 1978

[54] BICYCLE-TRAINING APPARATUS

[76] Inventor: Josef H. Hug, 2 Ziefeldstrasse, Olten, Switzerland, CH-4600

[21] Appl. No.: 756,440

[22] Filed: Jan. 3, 1977

[30] Foreign Application Priority Data

Jan. 19, 1976 Switzerland ..... 684/76

[51] Int. Cl.[2] ..... B62H 1/04; A63B 69/16

[52] U.S. Cl. ..... 280/296; 280/289 R; 272/73

[58] Field of Search ..... 280/289, 293, 295, 296; 272/73

[56] References Cited

U.S. PATENT DOCUMENTS

| | | | |
|---|---|---|---|
| 2,972,478 | 2/1961 | Raines | 280/293 |
| 3,572,758 | 3/1971 | Lee | 280/296 |
| 4,026,546 | 5/1977 | Omori | 280/293 |

*Primary Examiner*—Joseph F. Peters, Jr.
*Assistant Examiner*—Donn McGiehan

[57] ABSTRACT

A bicycle-training apparatus adapted to be used, as an accessory equipment, together with any existing bicycle, to convert it to a hometrainer cycle. It comprises a disassemblable frame with a base part to be driven by the rear wheel of the bicycle, said base part comprising movable elements, e. g. two rotatably arranged rollers.

1 Claim, 4 Drawing Figures

BICYCLE-TRAINING APPARATUS

BACKGROUND OF THE INVENTION

For athletic toughening-up, in many instances, so-called "home-trainer cycles" are used, which cycles permit one to carry out a training exercise, similar to cycle riding, in one's own home. Apart from the high price of this equipment, its main disadvantage consists in that it is relatively large and cumbersome and therefore makes it difficult or generally not possible to make permanent installation thereof in a dwelling, in an immediately-usable condition. This leads to the result that the training apparatus generally stands unused in a corner, or is used only very sporadically.

OBJECTS OF THE INVENTION

The object of the present invention is to provide accessory equipment for a bicycle which allows the conversion of any bicycle, whether big or small, new or used, into a home-trainer exercising cycle. Since most households already possess a bicycle, one achieves the advantage of eliminating a considerable cost factor which would otherwise be incurred in the acquisition of a home-trainer cycle.

A further object of the present invention is to provide accessory apparatus, which can be dismantled into its individual parts with relatively few manipulations and which can be stowed away in the smallest space and which can be used, at any time, in conjunction with any desired bicycle and which, after being used and dismantled from the bicycle, can be removed for storage so that the space used for both the accessory of the invention and the cicycle can be used for other purposes.

SUMMARY OF THE INVENTION

The trainer apparatus in accordance with the invention comprises a disassemblable frame consisting of a base part on which the rear wheel of the cicycle is mounted and which includes movable elements, each of which is drivable by the rear wheel of the bicycle. The base part which is provided with movable elements is also provided with and at least one support part fastened releasably thereto and said support is adapted to be releasably fastened to the frame part for a bicycle.

In a preferred embodiment, the base part comprises two rotary rollers which are arranged at a spacing from one another, and has an upwardly-open U-shaped support, between the side walls of which the rollers are mounted. In order to permit adaptation to bicycle wheels of different sizes, it is advantageous if the mutual spacing of the rollers is variable.

In accordance with a further development of the invention, an endless belt may be provided to extend around the rollers, in which case one of the rollers may be provided with a regulatable braking mechanism for regulating the tractive resistance. In the case of a bicycle having a change-speed gear, the arrangement may be such that the tractive resistance is selected at will by switching the individual gears.

In one embodiment of the invention, provision is made for the support part to comprise two individual supports which are fastened releasably to the base part and for each support to have a support arm which extends horizontally and which protrudes perpendicularly from the base part, and a support arm which extends obliquely upwards and which is situated at the free end of the horizontal supporting arm.

For mounting of the support arms on the base part, the latter may be provided with a piece of a square section, into which the horizontal support arms are inserted, two clamping screws being provided for restraining the horizontal support arms in the section.

Another possibility consists in providing a transverse traverse for mounting the support arms on the base part, this transverse traverse having its ends bent aside at right angles, and into which the support arms are loosely inserted.

In order to avoid uncontrolled oscillating to and fro of the front wheel of the bicycle, a guide tube may be arranged on the base part, this guide tube being adjustable in length in telescopic manner and carrying, at its free end, a guide member for the front wheel of the bicycle.

BRIEF DESCRIPTION OF THE DRAWINGS

In order that the invention may be more fully understood, embodiments of the invention will now be described, by way of example, with reference to the accompanying drawings, in which.

DESCRIPTION OF THE PREFERRED EMBODIMENTS

Figure 1:
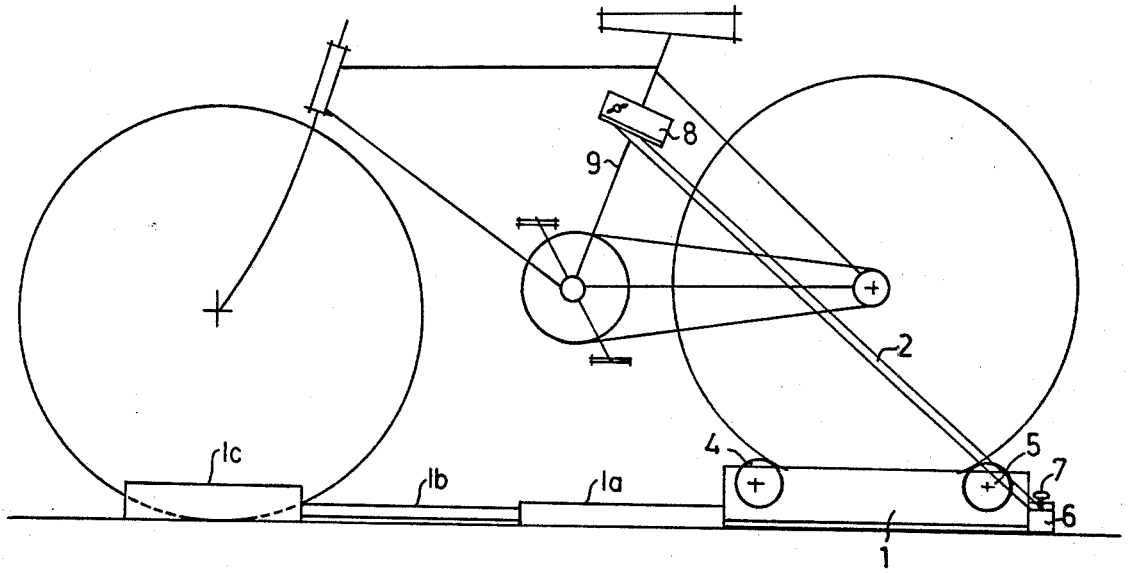
FIG. 1 is a diagrammatic side view illustrating a first embodiment of the training apparatus of the invention, appropriately fitted to a bicycle.

Throughout the various views, similar reference numerals have been allocated to similar parts.

Figure 3:
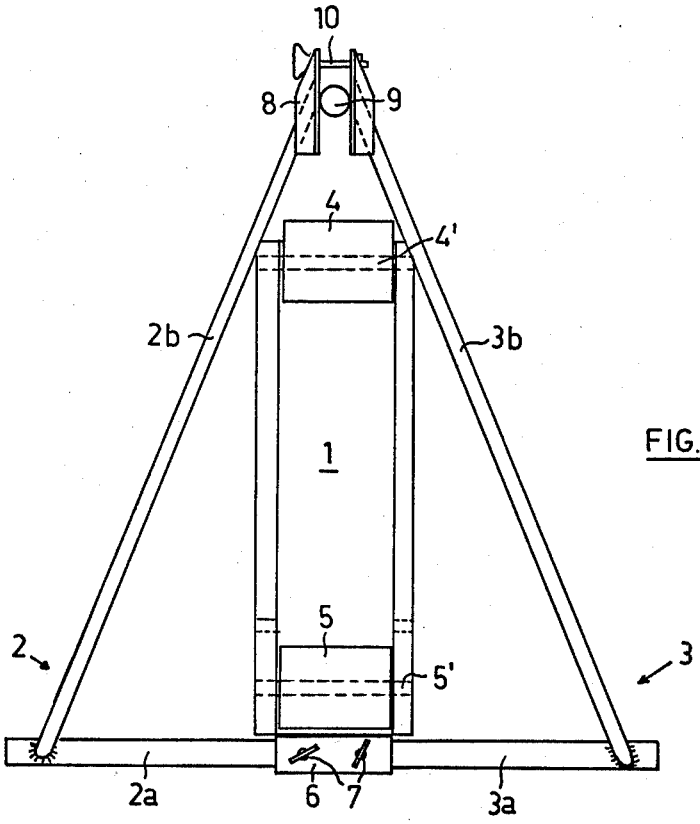
FIG. 3 is a plan view of the apparatus of FIGS. 1 and 2 and FIG. 4 is a view similar to FIG. 3, but illustrating a second embodiment.
Figure 2:
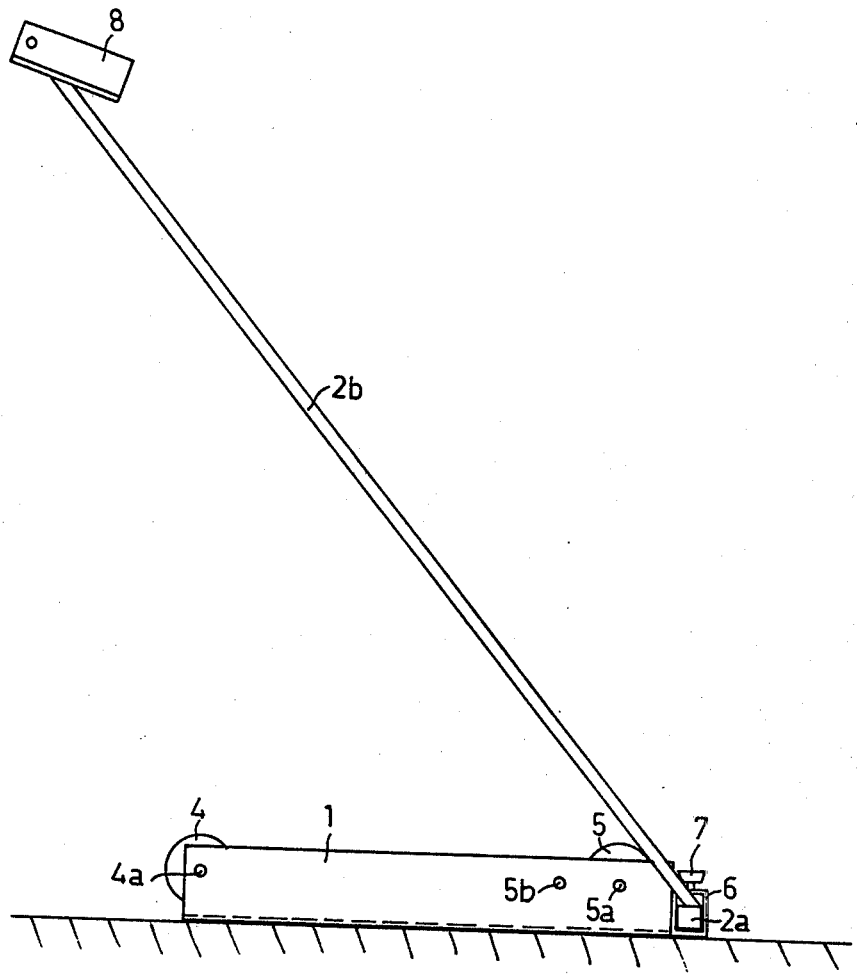
FIG. 2 is an enlarged detailed side view of the training apparatus of FIG. 1, deatched from the bicycle.

The bicycle-training apparatus of FIGS. 1, 2 and 3 consists basically of three parts, namely: a base part 1, a left-hand support 2 and a right-hand support 3. The base part 1 is essentially of a U-section, between the side walls of which rollers 4 and 5 are mounted. The size of the U-section is so selected that, upon practical use of the apparatus, the base thereof produces a bearing pressure, on the substrate, of about 0.45kp/cm$^2$.

The mounting of the rollers 4 and 5, which can be designed as simple cylindrical bodies made of wood, plastics material, hard rubber or the like, is effected by way of respective shafts 4' and 5', the ends of which are located in respective bores **4*a* or 5*a* in the side walls of the U-section. Additional bores 5*b* are provided in which the shaft 5*a* can be selectively installed, if desired, in order to obtain a smaller spacing between the rollers 4 and 5**, which may be necessary when a bicycle having a small wheel diameter is to be used.

The two supports 2 and 3 are fastened releasably to the rear end of the base part 1. These supports each comprise a horizontally-outwardly-extending support arm **2*a*, 3*a* respectively, as well as an oblique support arm 2*b*, 3*b*, respectively, extending obliquely upwards. For connecting the supports 2 and 3 to the base part 1, the latter is provided at its rear end, in the embodiment of FIG. 1 to 3, with a transverse square-sectioned socket 6. The horizontal support arms 2*a* and 3*a*, which are also designed as square sections, are introduced by their respective ends into the socket 6 so that they protrude laterally from the base part 1 at right angles to latter, thereby affording the necessary stability for the apparatus. The socket 6** is equipped with two clamping screws 7 which can be tightened against the horizontal support arms 2*a* and 3*a* to clamp the latter fast in the socket 6. The clamping screws 7 are preferably designed as wing screws, so that tightening and loosening by hand is possible.

Figure 4:
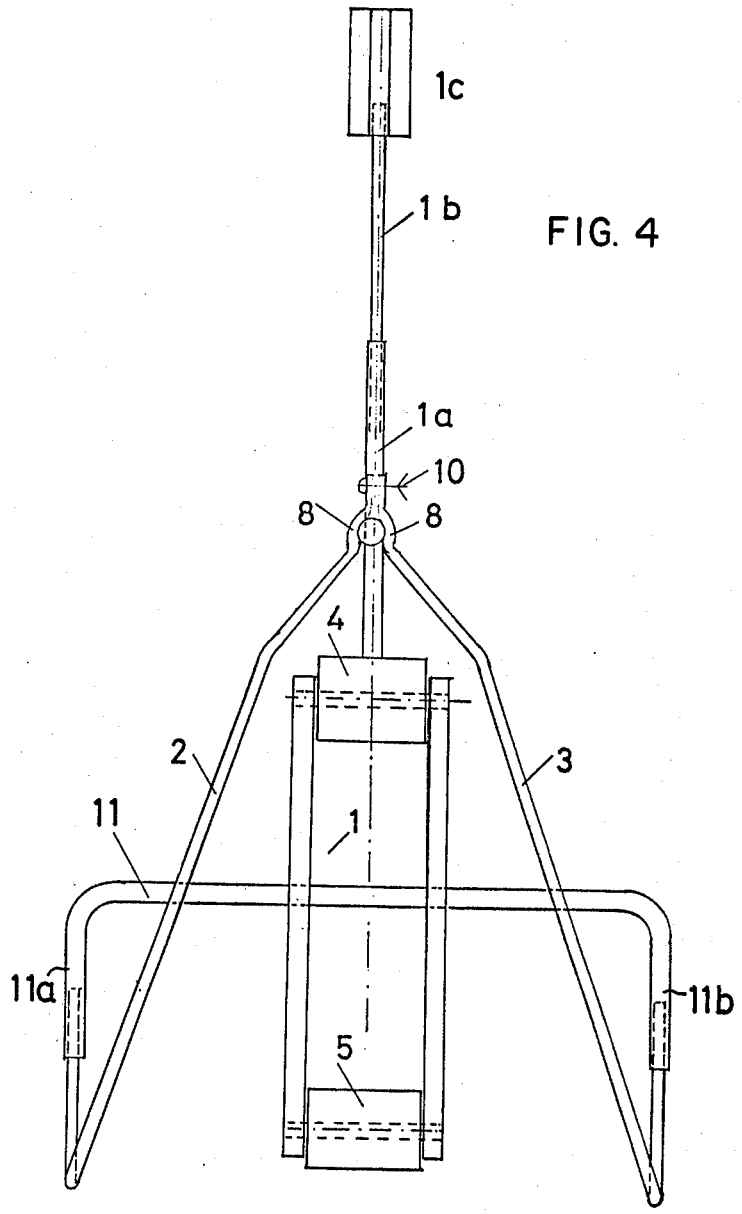

An alternative arrangement of the fastening is shown in FIG. 4. Inserted into the base part 1 from below is a transverse traverse 11 which is provided at each side with respective ends 11*a* and 11*b* each bent at a right angle. The support arms 2 and 3 are inserted freely into these ends; in this case a secure engagement is achieved without further fastening.

The oblique support arms 2*b* and 3*b*, extending obliquely upwards, are securely anchored (for example by being welded, FIG. 3) to the respective ends, remote from the base part 1, of the horizontal support arms 2*a* and 3*a*, or are (in accordance with FIG. 4) designed in one piece; and each bears, at its free end, a respective fastening flange 8. In use, as shown in FIG. 1, the two fastening flanges 8 locate one to each side of a frame part 9 of the bicycle with which the apparatus is used and are connected together by a screw 10, so that the frame part 9 is clamped between the flanges 8. The screw 10 is also advantageously a winged screw, or alternatively use may be made of a snap closure clamp so that installation and dismantling of the apparatus is possible without tools.

In the embodiment shown in FIG. 4, the base part 1 is provided additonally with a guide tube 1*a*, 1*b* which protrudes forwardly and which is adjustable in length in telescopic fashion and which carries, at its free end, a guide member 1*c*. This guide member 1*c* is intended for the guidance and for the height equalisation of the front wheel of the bicycle and guarantees that the bicycle is stable in the axial direction.

Naturally numerous possibilities exist for the further development of the proposed apparatus. Thus an endless belt may be provided around the two rollers 4 and 5. Then, it is no longer necessary to adapt the roller spacing to the wheel size of the bicycle. Moreover, one or both of the rollers may be provided with a regulatable braking mechanism, in order to be able to select the rolling resistance and thus the force necessary for rotating the rollers. Also one of the rollers may be provided with a connection for a tachometer, so that the pedalling speed can be monitored.

The training apparatus of the invention constitutes accessory equipment for a bicycle with the aid of which any bicycle can be converted within seconds into a home trainer. The apparatus is distinguished by a simple, stable and cheap construction. By loosening the wing screws 7 and 10 it can be dismantled within seconds into small parts and thus needs only a small space for storage.

What I claim is:

1. A bicycle-training attachment for a bicycle comprising:

a disassemblable frame having a base which can be driven by the rear wheel of the bicycle, said base having a base part, side walls and two releasable support arms extending from said base part which is attached by clamping to the frame of the bicycle;

each support arm comprising a horizontal support arm which extends horizontally and protrudes perpendicularly from the base part, an oblique support arm extending obliquely upwards situated at the free end of the respective horizontal support arm, and clamping means between the oblique support arms so that the frame part of the bicycle can be clamped;

a square-sectioned socket for mounting of the horizontal support arms on the base part laterally thereof so that the horizontal support arms are inserted into the socket and said clamping means, including clamping screws for restraining of the horizontal support arms in said socket;

said base being further provided with two moveable roller elements spaced apart from each other and being fastened releasably to said base part and the frame of said bicycle;

said two rotary rollers being arranged at an adjustable spacing from one another to support the rear wheel of the bicycle;

the side walls of said base part comprising an upwardly opening U-shaped support having a plurality of bores between which said rollers are mounted at different bore locations for rotary movement imparted by driving the rear wheel of the bicycle;

an adjustable guide tube which is arranged on the base part, said guide tube being adjustable in length in telescopic fashion and carrying, at its end, a guide member for the front wheel of the bicycle.

* * * * *